US010989026B2

(12) United States Patent
Al-Gouhi et al.

(10) Patent No.: US 10,989,026 B2
(45) Date of Patent: Apr. 27, 2021

(54) ELECTRICAL SUBMERSIBLE PUMP WITH GAS VENTING SYSTEM

(71) Applicant: Saudi Arabian Oil Company, Dhahran (SA)

(72) Inventors: Alwaleed Abdullah Al-Gouhi, Dhahran (SA); Osman M. Hieba, Khobar (SA); Robert Lee Cox, Tulsa, OK (US)

(73) Assignee: Saudi Arabian Oil Company, Dhahran (SA)

( * ) Notice: Subject to any disclaimer, the term of this patent is extended or adjusted under 35 U.S.C. 154(b) by 21 days.

(21) Appl. No.: 16/284,481

(22) Filed: Feb. 25, 2019

(65) Prior Publication Data

US 2019/0264518 A1 Aug. 29, 2019

Related U.S. Application Data

(60) Provisional application No. 62/635,303, filed on Feb. 26, 2018.

(51) Int. Cl.

| | |
|---|---|
| ***E21B 43/12*** | (2006.01) |
| ***E21B 21/08*** | (2006.01) |
| ***F04D 25/06*** | (2006.01) |
| ***E21B 41/00*** | (2006.01) |

(Continued)

(52) U.S. Cl.

CPC ..... *E21B 43/128* (2013.01); *E21B 21/08* (2013.01); *E21B 34/066* (2013.01); *E21B 41/0085* (2013.01); *E21B 43/38* (2013.01); *F04D 25/0606* (2013.01); *F04D 25/0686* (2013.01)

(58) Field of Classification Search

CPC .... E21B 43/128; E21B 21/08; E21B 41/0085; E21B 34/066; F04D 25/0686; F04D 25/0606

See application file for complete search history.

(56) References Cited

U.S. PATENT DOCUMENTS

| | | | |
|---|---|---|---|
| 5,154,588 | A | 10/1992 | Freet et al. |
| 6,497,287 | B1 | 12/2002 | Podio et al. |
| 6,533,039 | B2 | 3/2003 | Rivas et al. |

(Continued)

FOREIGN PATENT DOCUMENTS

| | | |
|---|---|---|
| RU | 138787 | 3/2014 |
| RU | 2632607 | 10/2017 |

OTHER PUBLICATIONS

International Search Report and Written Opinion issued in International Application No. PCT/US2019/019380 dated May 14, 2019, 14 pages.

(Continued)

*Primary Examiner* — D. Andrews

(74) *Attorney, Agent, or Firm* — Fish & Richardson P.C.

(57) ABSTRACT

A gas venting system for an electrical submersible pump (ESP system includes a shroud and a venting system fluidically coupled to the shroud. The shroud is configured to encapsulate and fluidically seal an ESP system that includes an ESP and a motor operatively coupled to the ESP to drive the ESP. The shroud can receive well fluids including liquid components and gaseous components. The venting system can flow a portion of the gaseous components towards the surface before the gaseous components enter the ESP based on a quantity of the gaseous components received in the shroud exceeding a threshold gaseous component value.

14 Claims, 7 Drawing Sheets

(51) Int. Cl.
*E21B 34/06* (2006.01)
*E21B 43/38* (2006.01)

(56) References Cited

U.S. PATENT DOCUMENTS

| | | | | |
|---|---|---|---|---|
| 2008/0093083 | A1 | 4/2008 | Johnson | |
| 2008/0245525 | A1 | 10/2008 | Rivas et al. | |
| 2009/0223662 | A1 | 9/2009 | Shaw et al. | |
| 2010/0096141 | A1 | 4/2010 | Brown et al. | |
| 2010/0108307 | A1* | 5/2010 | Brown | E21B 43/124 166/105.5 |
| 2010/0258306 | A1 | 10/2010 | Camilleri et al. | |

OTHER PUBLICATIONS

Rooks et al., "Integral Pod Intake for Electrical Submersible Pumps," SPE 160864, presented at the SPE Saudi Arabia Section Technical Symposium and Exhibition in Al-Khobar, Saudi Arabia, Apr. 8-11, 2012, 8 pages.

Carvalho et al., "Modeling a Jet Pump with an Electrical Submersible Pump for Production of Gassy Petroleum Wells," SPE 48934, Society of Petroleum Engineers, SPE Annual Technical Conference and Exhibition held in New Orleans, Louisiana, Sep. 27-30, 1998, 13 pages.

* cited by examiner

ELECTRICAL SUBMERSIBLE PUMP WITH GAS VENTING SYSTEM

CROSS-REFERENCE TO RELATED APPLICATIONS

This application claims priority to U.S. Application Ser. No. 62/635,303, filed on Feb. 26, 2018, the entire contents of which are incorporated herein by reference.

TECHNICAL FIELD

This disclosure relates to artificial lift systems implemented in wellbores, for example, to transport hydrocarbons from a hydrocarbon reservoir to a surface.

BACKGROUND

Hydrocarbons, for example, oil, natural gas, combinations of them, or other hydrocarbons, are trapped in hydrocarbon reservoirs beneath a surface of the Earth. Wellbores are formed from the surface to the hydrocarbon reservoirs to recover the trapped hydrocarbons. In some instances, the hydrocarbons can flow to the surface due to a pressure differential between the reservoir pressure and the surface pressure. In some instances, artificial lift systems can be implemented in the wellbore to assist the hydrocarbons to flow to the surface. Electrical submersible pumps (ESPs) are examples of such artificial lift systems.

SUMMARY

This disclosure describes technologies relating to electrical submersible pumps with gas venting systems.

Certain aspects of the subject matter described here can be implemented as a well tool system that includes a downhole ESP system, a downhole shroud and a downhole venting system. The downhole ESP system includes a downhole ESP can positioned in a wellbore formed in a hydrocarbon reservoir. The downhole ESP can receive hydrocarbons released from the hydrocarbon reservoir into the wellbore and to flow the hydrocarbons to a surface of the wellbore through a production tubing extending from an uphole end of the downhole ESP system to the surface. The hydrocarbons include liquid components and gaseous components. The downhole ESP system includes a downhole ESP motor that is operatively coupled to the downhole ESP to provide power to the downhole ESP to flow the hydrocarbons to the surface. The downhole shroud can encapsulate and fluidically seal the downhole ESP system. An uphole end of the downhole shroud can couple to a downhole end of the production tubing. The gaseous components separate from the liquid components in the downhole shroud. The downhole venting system is fluidically coupled to the downhole shroud. The downhole venting system can flow the gaseous components towards the surface before the gaseous components enter the downhole ESP.

In an aspect combinable with any of the other aspects, the downhole shroud includes a sealing assembly forming a fluidic seal at an uphole end of the downhole shroud. The downhole venting system includes a vent line tubing fluidically coupled to the downhole shroud and the production tubing. The vent line tubing can flow the gaseous components from the downhole shroud to the production tubing.

In an aspect combinable with any of the other aspects, the vent line tubing includes a first opening fluidically coupled to an inner volume of the downhole shroud, and a second opening positioned uphole relative to the first opening and can fluidically couple to the production tubing.

In an aspect combinable with any of the other aspects, the first opening is fluidically coupled to an uphole end of the downhole shroud.

In an aspect combinable with any of the other aspects, the vent line tubing has a length sufficient such that the second opening is can fluidically couple to the production tubing immediately below a wellhead of the wellbore.

In an aspect combinable with any of the other aspects, the vent line tubing is a first vent line tubing. The downhole venting system includes a second vent line tubing.

In an aspect combinable with any of the other aspects, a jet pump can be positioned uphole of the downhole shroud. The jet pump can draw the gaseous components from the downhole shroud towards the surface.

In an aspect combinable with any of the other aspects, the jet pump can be positioned axially in-line with the production string and can be fluidically coupled to the production tubing. The jet pump includes a venturi that can generate a pressure differential in response to the hydrocarbons flowing through the venturi. The pressure differential is sufficient to draw the gaseous components from the downhole shroud towards the surface.

In an aspect combinable with any of the other aspects, the vent line tubing is coupled to the jet pump.

In an aspect combinable with any of the other aspects, the second opening of the vent line tubing is coupled to a downhole end of the jet pump.

In an aspect combinable with any of the other aspects, a valve system is fluidically coupled to the vent line tubing. The valve system can control flow of the gaseous components through the vent line tubing.

In an aspect combinable with any of the other aspects, the valve system includes a valve and a valve controller operatively coupled to the valve. The valve controller can open or close the valve in response to fluidic conditions in the wellbore.

In aspect combinable with any of the other aspects, the valve controller includes one or more processors and a computer-readable medium storing instructions executable by the one or more processors to perform operations that include receiving one or more signals representing the fluidic conditions in the wellbore and transmitting one or more signals to open or close the valve responsive to the fluidic conditions represented by the one or more signals.

In another aspect combinable with any of the other aspects, the fluidic conditions include a volume percentage of free gas at an intake of the ESP. The operations include receiving the one or more signals representing that the volumetric percentage of free gas at the intake of the ESP is greater than a first threshold volumetric percentage, and transmitting the one or more signals to open the valve responsive to the volumetric percentage of free gas at the intake of the ESP being greater than the first threshold volumetric percentage.

In another aspect combinable with any of the other aspects, the operations include receiving the one or more signals representing that the volumetric percentage of free gas at the intake of the ESP is less than a second threshold volumetric percentage, and transmitting the one or more signals to close the valve responsive to the volumetric percentage of free gas at the intake of the ESP being less than the second threshold volumetric percentage.

Certain aspects of the subject matter described here can be implemented as a method. Hydrocarbons from a hydrocarbon reservoir are received in a shroud encapsulating and fluidically sealing an ESP system. The ESP system is positioned in a wellbore. The hydrocarbons are separated into gaseous components and liquid components within the shroud. At least a portion of the gaseous components excluding the liquid components is flowed from the shroud toward the surface through vent line tubing fluidically coupled to the shroud and extending toward a surface of the wellbore before the portion of the gaseous components flows into the ESP system.

Certain aspects of the subject matter described here can be implemented as a well tool system that includes a shroud and a venting system fluidically coupled to the shroud. The shroud is configured to encapsulate and fluidically seal an ESP system that includes an ESP and a motor operatively coupled to the ESP to drive the ESP. The shroud can receive well fluids including liquid components and gaseous components. The venting system can flow a portion of the gaseous components towards the surface before the gaseous components enter the ESP based on a quantity of the gaseous components received in the shroud exceeding a threshold gaseous component value.

The details of one or more implementations of the subject matter described in this specification are set forth in the accompanying drawings and the description that follows. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

In a wellbore in which an ESP is implemented, a gas lock may occur when liquid and gas separate in the tubing above the ESP or inside the ESP itself. Gas locking occurs when the pump is unable to lift the fluid column in the tubing above. The net result of excessive gas at the pump intake is that the gas can potentially accumulate into a long continuous column in the pump, thereby impeding the pumps ability to generate discharge pressure. In cases in which the pump does not actually gas lock, the pump can suffer head degradation and low efficiency when high vapor-to-liquid ratios are being pumped. Thus, ESP performance is limited by the amount of free gas that could be tolerated before gas locking would occur. Such gas locking can cause a catastrophic failure of the ESP because the pump is no longer moving fluid, resulting in overheating of the ESP during normal operation. Some techniques to minimize the possibility of or avoid gas lock include separating the gas from the fluid prior to entering the pump inlet or creating gas handling pumps which can pump larger gas by volume percentages of up to 70% before pump head degradation and gas locking occurs. Another technique is to ensure that the pump intake pressure remains above the bubble point pressure of fluid being produced.

This disclosure describes an ESP system encapsulated inside a shroud. Any gas will accumulate at the top of the shroud and will then be vented into the production tubing by a vent line. The vent line will enter the production tubing below the wellhead where the minimum pressure in the tubing exists compared to any other points in the tubing because of friction loss. Friction loss (or skin friction) is the loss of pressure or "head" that occurs in a tubing due to the effect of the fluid's viscosity near the surface of the tubing. The components described in this disclosure, for example, the ESP, the ESP motor, the shroud, and other components, are downhole components designed and constructed to operate in a downhole environment. That is, each component is ruggedized and constructed to operate, without failing, under the downhole environment which can include higher pressure or temperature compared to a surface of the Earth. Each component is also constructed to operate, without failing, in the presence of or upon contacting well fluids including hydrocarbons and debris, for example, subterranean zone rock or other debris, carried by the well fluids.

Figure 1A:
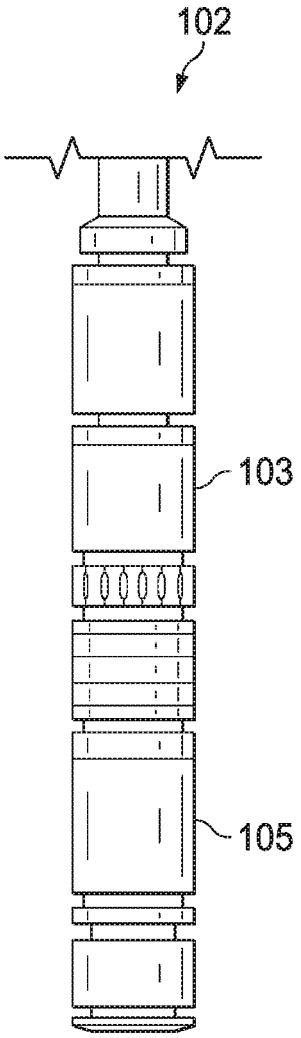
FIG. 1A is a schematic of an example of an electrical submersible pump (ESP) system.

FIG. 1A is a schematic of an example of an electrical submersible pump (ESP) system 102. The ESP system 102 includes an ESP 103 and an ESP motor 105 that is operatively coupled to the ESP 103 to drive the ESP 103. In some implementations, the ESP 103 can be a middle or upper tandem model pump of any volume. Physical parameters and volumetric capacities of pumps from which the ESP 103 can be selected are shown in the table below:

| Pump Outer Diameter (inches) | Flow Range (cubic meters per day) @ best efficiency point (BEP) |
|---|---|
| 5.38 | 227-1521 |
| 5.62 | 2053-3852 |
| 6.74 | 1267-1921 |

The ESP motor 105 can be a lower tandem model motor. Physical parameters and operational ranges of motors from which the ESP motor 105 can be selected are shown in the table below:

| Motor Outer Diameter (inches) | Horsepower @ 60 Hertz | Name Plate Voltage Range @ 60 Hertz | Name Plate Amperage Range @ 60 Hertz |
|---|---|---|---|
| 5.43 | 480 | 1201-2525 | 94-43 |
| 5.62 | 210 | 2490-3720 | 52-34 |
| 5.62 | 441 | 2406-3855 | 111.4-69.6 |

Figure 1B:
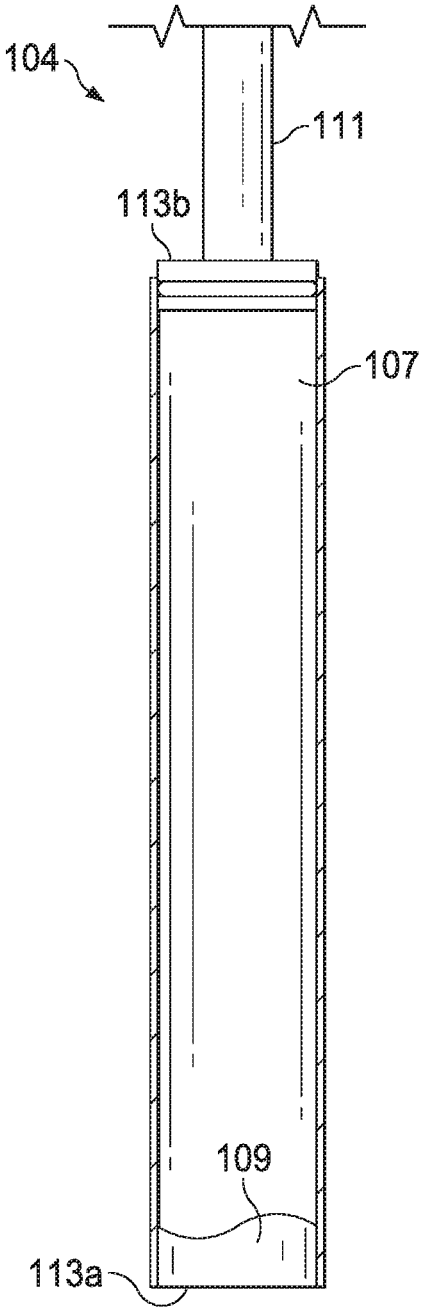
FIG. 1B is a schematic of an example of a shroud to be coupled to the ESP system of FIG. 1A.

FIG. 1B is a schematic of an example of a shroud 104 to be coupled to the ESP system 100 of FIG. 1A. The shroud 104 has a hollow body 107 having an axial length greater than an actual length of the ESP system 102 and an inner radius greater than an outer radius of the ESP system 102. The dimensions of the body 107 are selected to receive the ESP system 102 within the hollow portion of the body. In some implementations, a minimum clearance between the outer surface of the ESP system 102 and the inner surface of the body 107 can be substantially 0.5 inches, where "substantially" represents a variation of 5% in the clearance. The shroud 104 has a downhole end portion 109 that is attached to the downhole end of the body 107. A sealing assembly 113*a* forms a fluidic seal between the downhole end portion 109 and tubing through which hydrocarbons 101 (FIG. 1C) are flowed to the ESP system 102. For example, the sealing assembly 113*a* can be a POD bottom sub of 7⅝". The shroud 104 has an uphole end portion 111 that is attached to the uphole end of the body 107. A sealing assembly 113*b* forms a fluidic seal between the uphole end of the body 107 and the downhole end of the uphole end portion 111. For example, the sealing assembly 113*b* can be a POD hanger sub-assembly.

Figure 1C:
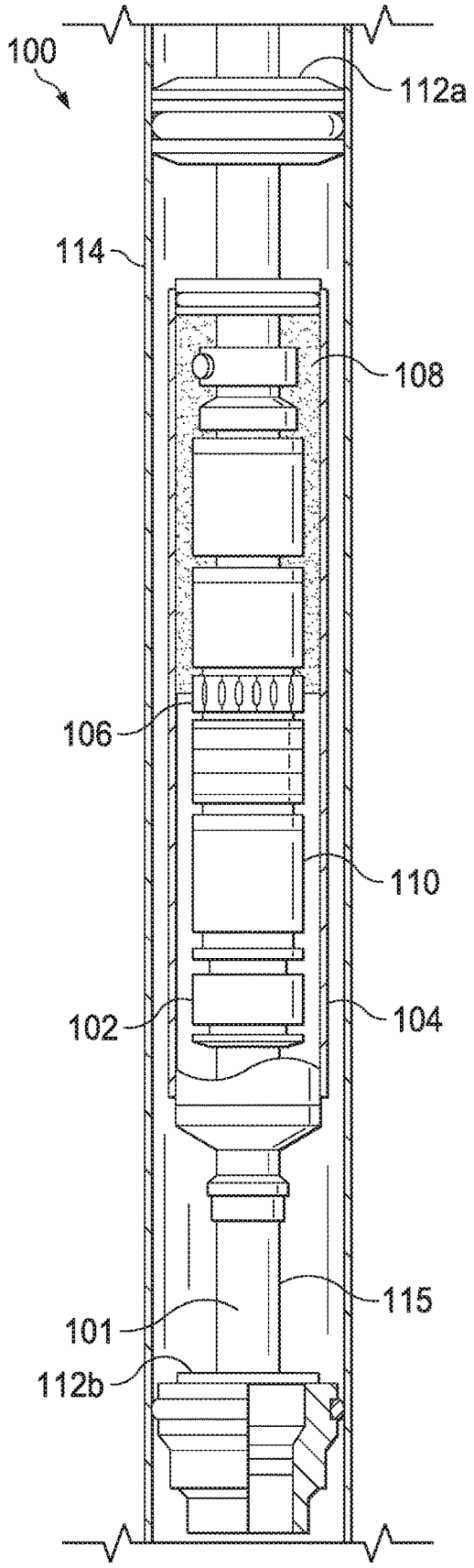
FIG. 1C is a schematic of an example of the ESP system of FIG. 1A coupled to the shroud of FIG. 1B positioned in a schematic of an example of a wellbore.

FIG. 1C is a schematic of an example of the ESP system 100 of FIG. 1A coupled to the shroud 104 of FIG. 1B positioned in a schematic of an example of a wellbore. The wellbore can be formed from a surface to a depth in a subterranean zone, which can include a formation, a portion of a formation or multiple formations. At the depth, the subterranean zone can include entrapped hydrocarbons 111 (for example, oil, gas, combinations of them or other hydrocarbons) which can be raised to the surface using the ESP system 102. The wellbore can be cased (for example, along an entire length of the wellbore or along a portion or portions of the length of the wellbore) or can be uncased. For example, the wellbore can be cased at least along the portion of the wellbore in which the ESP system 100 is disposed, and can be cased or uncased in other portions of the wellbore. As described earlier, the ESP system 102, which includes the ESP 103 and the ESP motor 105, can be positioned within the shroud 104 and sealed at the downhole end portion 109 and the uphole end of the body 107 using the sealing assemblies 113*a* and 113*b*, respectively. The shroud 104, carrying the ESP system 102, can then be positioned within the wellbore, for example, at a depth at which the ESP system 102 is to be operated to lift the hydrocarbons 101 to the surface of the wellbore.

In some implementations, a packer 112*a* is positioned uphole of the ESP system 102 and is coupled to the uphole end portion 111 of the shroud 104. The packer 112*a* fluidically isolates the portion of the wellbore (or, if the wellbore is cased, the portion of the casing 114) uphole of the packer 112*a* from the portion downhole of the packer 112*a*. The packer 112*a* can include an opening through which the uphole end portion 111 can pass. In some implementations, the packer 112*a* can be a deep set packer that can protect the casing annulus from contact with the hydrocarbons 111 and also serve as a barrier for well control. The packer 112*a* can include a packer penetrator system through which cables (for example, power cables or cable carrying other information) can be passed to the ESP motor 105. For example, the packer 112*a* can be a production packer with feed-through ports for receive and pass through extension leads to the ESP motor 105.

In some implementations, a packer 112*b* is positioned downhole of the ESP system 102. Similar to the packer 112*a*, the packer 112*b* creates a fluidic isolation between portions uphole and downhole of the packer 112*b*. The packer 112*b* can include an opening through which tubing 115 through which the hydrocarbons 111 flow, can be passed to fluidically and sealingly couple to the bottom end portion 109 of the shroud 104. In some implementations, the packer 112*b* can be a permanent packer, that is, a mechanical packer with large packing surfaces that enables isolation of several zones. The packer 112*b* offers necessary anchoring to the ESP system 100. The packer 112*b* can connect, in sequence, with other well tools, for example, a hydraulic disconnect tool, a telescope joint, handling sub, cross overs and the sealing assembly 113*a*. In this manner, the packer 112*b* directs the hydrocarbons 111 released from the subterranean zone into the tubing 115, which then carries the hydrocarbons 111 into the shroud 104 to be received by the ESP system 102. The intake 102 of the ESP 103 draws the hydrocarbons 111 to be lifted to the surface and flows the hydrocarbons 111 into a production tubing 208 (FIG. 2) that is uphole of the shroud 104. The shroud 104 fills with the hydrocarbons 111, which can include multi-phase fluids, that is, fluids with gas and liquid components. Over time, the gaseous components 108 can rise to the uphole portion of the body 107 while the liquid components 110 settle to the downhole portion of the body 107. Because the shroud 104 is fluidically sealed at the uphole and downhole ends, the pressure on the gaseous components 108 can increase as the volume of the liquid components 110 in the shroud 104 increases. If not vented, then the gaseous components 108 can enter the ESP 103 causing gas lock.

Figure 2:
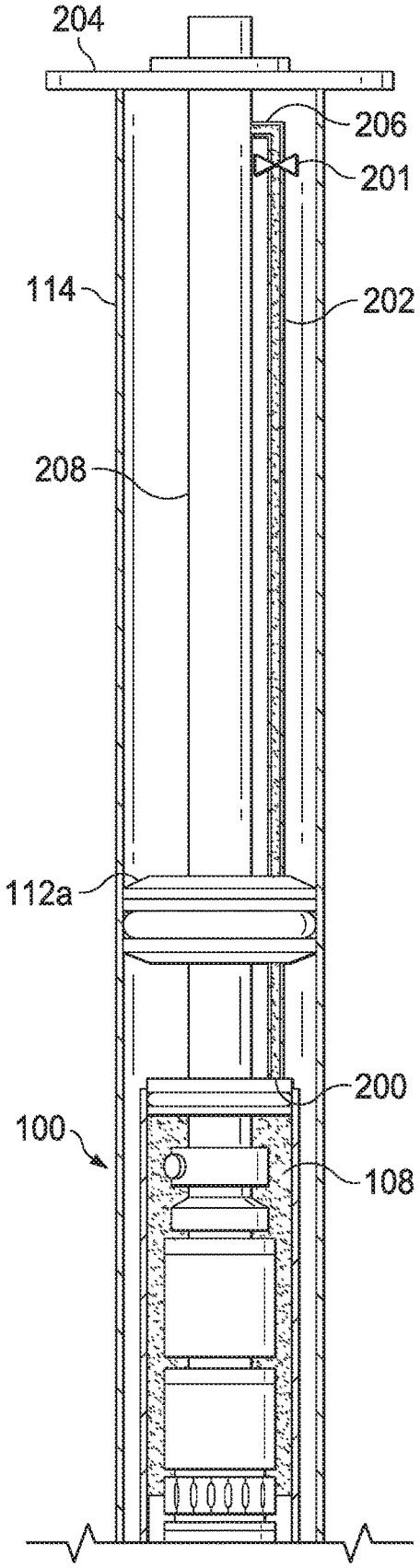
FIG. 2 is a schematic of a vent line to carry accumulated gas to a surface.

FIG. 2 is a schematic of a vent line to carry accumulated gas to a surface. In some implementations, a vent line 202 can be operatively connected to the shroud to carry the gaseous components 108 from within the body 107 of the shroud 104 to the surface of the wellbore. The vent line 202 can include tubing designed and constructed to fluidically couple, on one end 200, to an inner volume of the body 107 of the shroud 104. For example, the vent line can be manufactured using a material that can resist corrosion, for example, due to hydrogen sulfide, carbon dioxide or other gases that can flow through the vent line. The vent line 202 can pass through the packer 112A and the sealing assembly 113*b* to fluidically couple to the body 107 at the end 200. Swage locks (for example, about ¾ inches in size) can be used to maintain a seal at the opening 200 so that the gas does not leak out of the shroud. The other end 206 of the vent line 202 is connected to the production tubing 208 that carries the hydrocarbons 111 to the surface. In some implementations, a vent valve is used to couple the other end 206 of the vent line 202 with the production tubing 208. The vent valve maintains a seal at the other end 206. In some implementations, the vent line 202 can extend as close to the surface (for example, to the base of the wellhead 204) as possible before reconnecting with the production tubing 208. At this location, the fluidic pressure within the vent line 202 at this location will be less than that in other, comparatively downhole locations due to friction loss. Alternatively, the other end 206 can be reconnected to the production tubing 208 at any location uphole of the packer 112*a*.

The vent line 202 can also include a venting mechanism 201, for example, a vent valve. As described earlier, the gaseous components 108 can accumulate in an uphole end of the body 107. The venting mechanism 201 can vent the gaseous components 108 into the vent line 202 through the opening 200. In this manner, the gaseous components 108 can exit the body 107, thereby decreasing a pressure and quantity of the gaseous components 108 in the shroud 107. Subsequently, the venting mechanism 201 can close the opening 200 allowing the gaseous component 108 to once again fill the body 107. This cycle of filling and venting can continue thereby preventing the gaseous component 108 from entering the pump intake 106 (FIG. 1) and causing gas lock. The venting mechanism 201 can be positioned within the shroud 107, outside the shroud 107 immediately uphole of the shroud 107, nearer to a surface of the wellbore, or at any position in between.

The venting mechanism 201 can be implemented as a pressure valve. For example, the venting mechanism 201 can be a mechanically operated vent valve. When the pressure near an uphole end of the body 107 due to the gaseous component 108 increases beyond a threshold pressure, the venting valve can open to release the gaseous component 108 into the vent line 202. Release of the gaseous component 108 decreases the pressure in the body 107 causing the venting valve to close. Alternatively or in addition, the venting mechanism 201 can be a valve controllable using programmable logic control (PLC). Such a valve can include a spring and an electric magnet that is actuated by a programmable logic controller that sends a signal to the valve to open or close through a wire cable 205 connected to the valve, the wire cable fed through ports in the packer 112*a*. In such implementations, the programmable logic can include one or more of several factors including, for example, the pressure inside the body 107, volume percentage of gas in the fluid at the inlet of the ESP 103, combinations of them or other factors. Also, in some implementations, the programmable logic controller can be included in the surface of the drive of the ESP 103.

Figure 3:
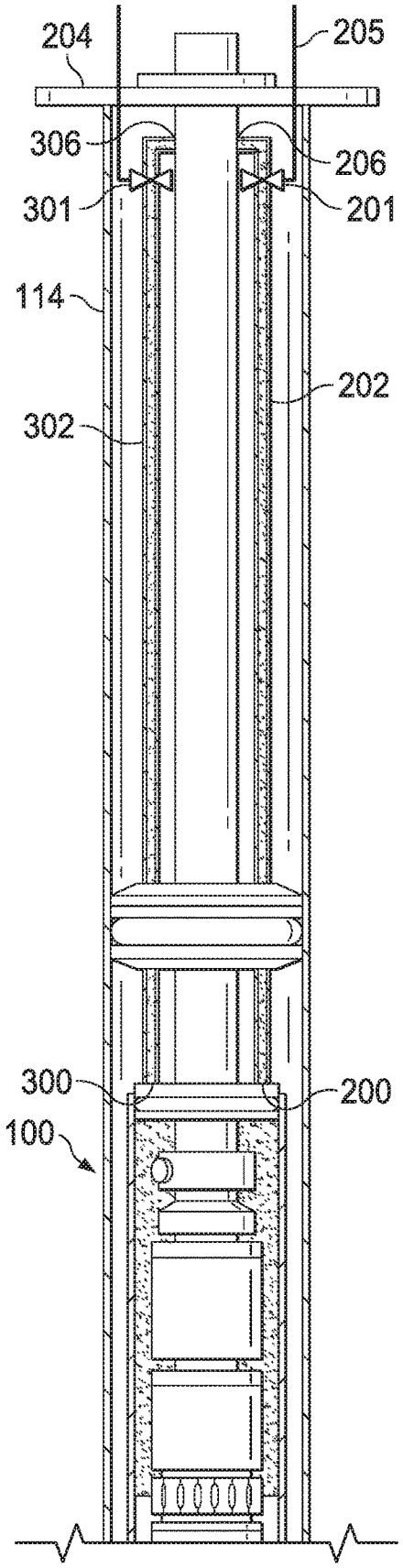
FIG. 3 is a schematic of two vent lines to carry accumulated gas to the surface.

FIG. 3 is a schematic of two vent lines to carry accumulated gas to the surface. The first vent line can be identical to the vent line 202 described earlier with reference to FIG. 2. The second vent line 302 can be substantially identical to the vent line 202. The second vent line 202 can include an opening 300, substantially identical to the opening 200, to fluidically couple the second vent line 302 to the body 107 and another opening 306, substantially identical to the opening 206, to fluidically couple the second vent line 302 to the production tubing 306. The second vent line can include a second venting mechanism 301 substantially identical to the first venting mechanism 201.

Figure 4:
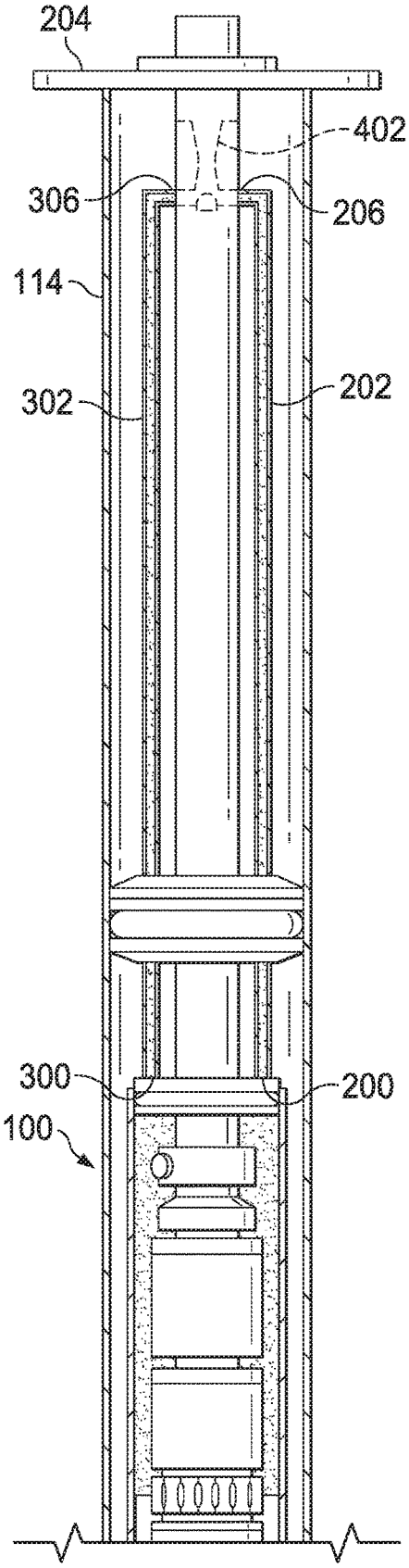
FIG. 4 is a schematic of a jet pump to draw gas through vent lines.

FIG. 4 is a schematic of a jet pump 402 to draw gas through vent lines. The jet pump 402 can be positioned uphole of the shroud 104, for example, immediately below the base of the wellhead 204, and in-line with the production tubing 114. The hydrocarbons 111 lifted by the ESP system 102 can be flowed through the production tubing 114 and through the jet pump 402 before exiting the wellbore through the wellhead 204. In some implementations, the jet pump 402 can have an eductor design, that is, a venturi-like construction whereby a cross-sectional flow area of the jet pump 402 decreases, then increases in the flow direction of the hydrocarbons 111. The openings 206 and 306 of the vent lines 202 and 302, respectively, can be fluidically coupled to the uphole end of the jet pump 402 before the decrease in the cross-sectional flow area. As the hydrocarbons 111 flow through the jet pump 402, the change in the cross-sectional area causes a change in the differential pressure in the vent lines 202 and 302 causing the gaseous components 108 in the body 107 to be sucked in the uphole direction through the openings 200 and 300, respectively.

Similar to the implementation of FIG. 3, the implementation of FIG. 4 shows two vent lines 202 and 302, including corresponding openings 200 and 300, respectively, connected to the body 107 of the shroud 104, and openings 206 and 306, respectively, connected to the production tubing 114. Alternatively, the jet pump 402 can be implemented using one vent line or with more than two vent lines.

Figure 5:
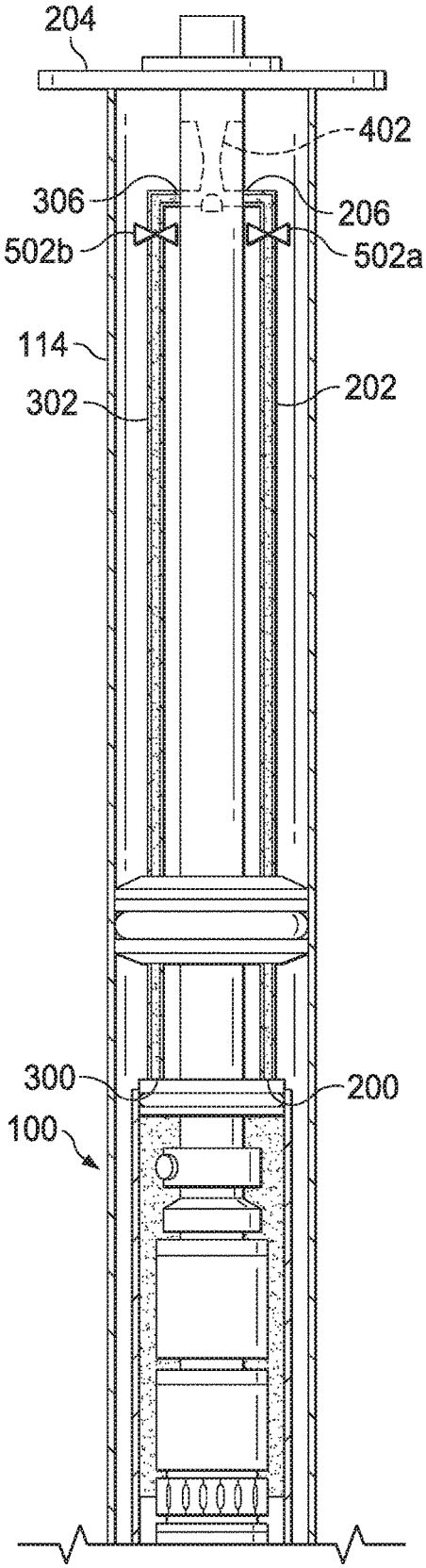
FIG. 5 is a schematic of valves to control flow of gas through vent lines.

FIG. 5 is a schematic of a valve system including valves to control flow of gas through vent lines. In some implementations, a valve can be operatively connected to each vent line (for example, valve 502*a* in vent line 202, valve 502*b* in vent line 302) to control the flow of gaseous components 108 to the production tubing 114. The valve can be an on/off nozzle-type venting valve fluidically coupled to the vent line immediately above the shroud 104. The valve system includes a valve controller to control the valve. In some implementations, the valve controller can be implemented as computer instructions stored on a computer-readable medium and executable by one or more processors. For example, the valve controller can determine free gas at the pump intake 106 using one or more sensors, for example, a pressure sensor, a volume sensor, temperature sensor, any combination of them or other sensors. In some implementations, any one or more or all of the venting mechanism 201, the venting mechanism 302, the valve 502*a* or the valve 502*b* can include the one or more sensors. The venting mechanisms (or valves) can be non-return valves that are normally in a closed state. The sensors can sense parameters of the fluids at the inlet of the ESP 103 or parameters inside the body 107 or parameters of the fluid inside the body 107 (or other parameters), and transmit the sensed parameters (for example, pressure, volume, temperature) to the valve controller (for example, the programmable logic controller) at the surface. The valve controller receives the sensed parameters and compares the same with stored threshold parameters. Based on a result of the comparison, the valve controller can transmit a signal to the venting mechanism (or the valves) to open if closed, to close is open, to remain open or to remain closed. For example, when the valve controller determines that the volume percentage of free gas is at or exceeds a certain threshold (for example, 25% or more volume percentage), then the valve controller can transmit an instruction to the valve to open. When the valve controller determines that the volume percentage of free gas it at or less than a certain threshold (for example, 10% or less volume percentage), then the valve controller can transmit an instruction to the valve to close.

Figure 6:
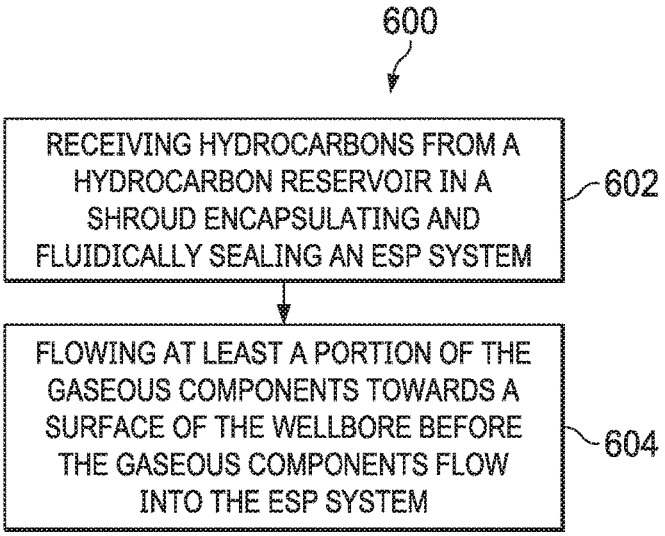
FIG. 6 is a flowchart of an example of a process of preventing gas lock in an ESP.

FIG. 6 is a flowchart of an example of a process 600 of preventing gas lock in an ESP. At 602, hydrocarbons from a hydrocarbon reservoir are received in a shroud encapsulating and fluidically sealing an ESP system. The ESP system is positioned in a wellbore. The hydrocarbons are separated into gaseous components and liquid components within the shroud. At 604, the hydrocarbons are flowed through vent line tubing toward a surface of the wellbore before the gaseous components flows into the ESP system. In this manner, gas lock in the ESP system can be prevented.

Figure 7:
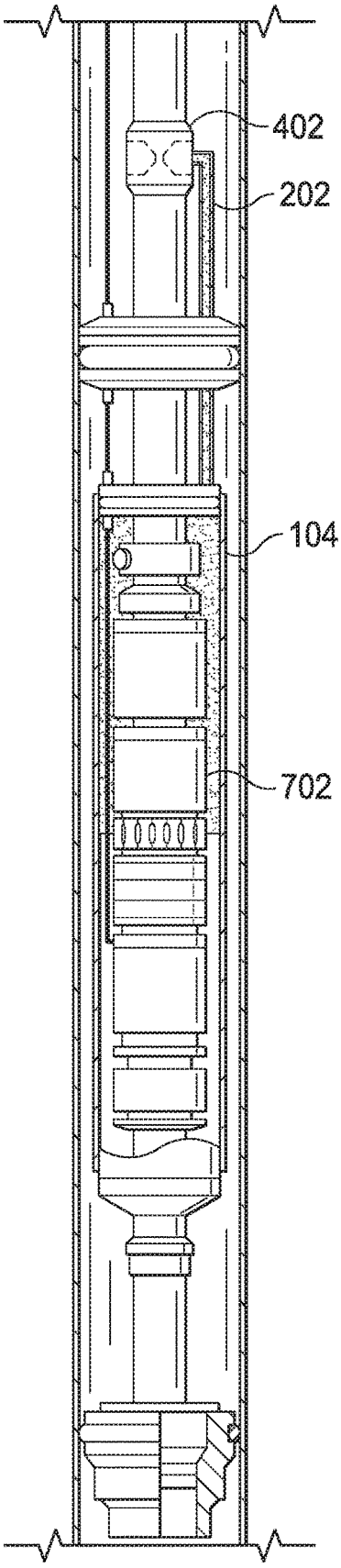
FIG. 7 is a schematic of an example of an implementation of an ESP system.

FIG. 7 is a schematic of an example of an implementation of an ESP system. The ESP system includes the shroud 104, the sealing assembly (for example, the packer 112*a*) uphole of the shroud 104, a vent line 202 passing through the sealing assembly to transfer fluids collected in the shroud 104 to portions uphole of the shroud 104 and a jet pump 402 positioned immediately below the wellhead to draw the fluids accumulated in the shroud 104 toward the surface. The ESP system also includes a gas handler 702 that can retain the free gas into the liquid in the shroud 104 before the gas enters the pump. The gas handler 702 is a mechanical device that contains multiple axial screw type impellers and diffusers. The flow volume (oil+gas) is compressed in the axial type impellers that breaks the gas bubbles into smaller gas bubbles in the diffuser. This action results in homogeneous gas-liquid mixture without jeopardizing the ESP operation to gas lock, that is, the stoppage of ESP production due to gas accumulation at the intake of the ESP. Then, the gas-liquid fluid is pushed into the ESP stages with no gas lock. To support the gas handler 702, in some implementations, a gas separator can be added below the gas handler 702 and above the pump intake 106. In some implementations, the jet pump 402 can be positioned within the shroud 104, for example, downhole of the uphole end 111 of the body 107 of the shroud 104.

Figure 8:
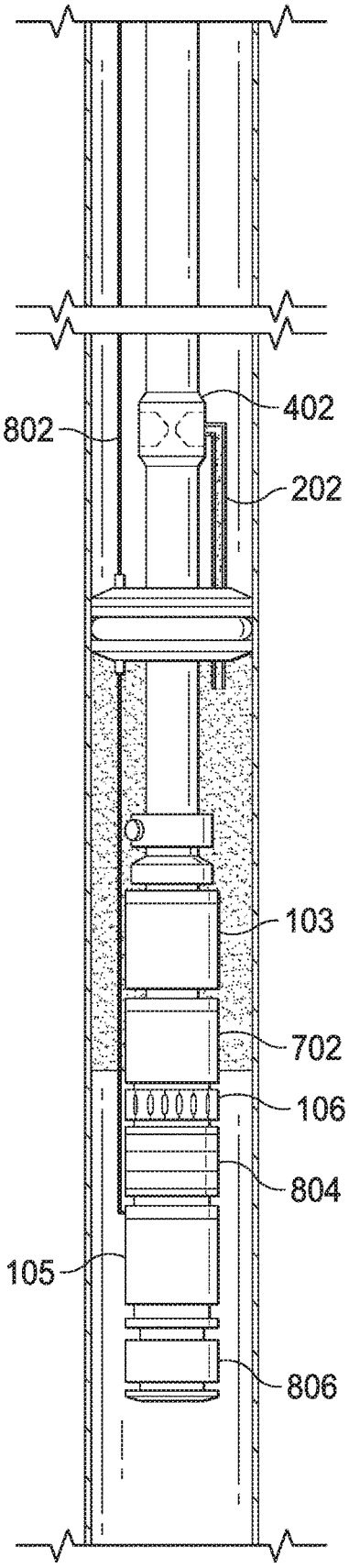
FIG. 8 is a schematic of an example of an implementation of an ESP system.
Figure 9:
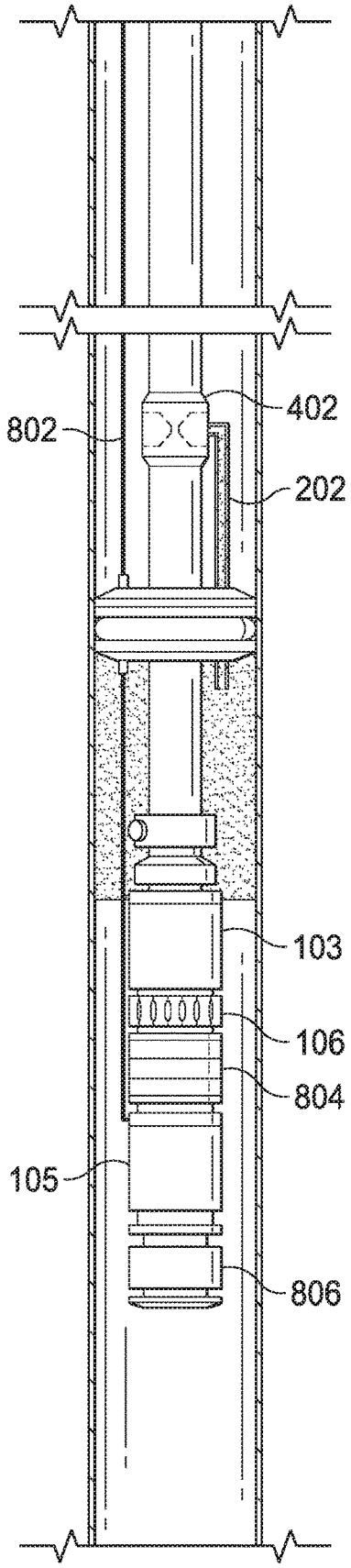
FIG. 9 is a schematic of an example of an implementation of an ESP system.
Figure 10:
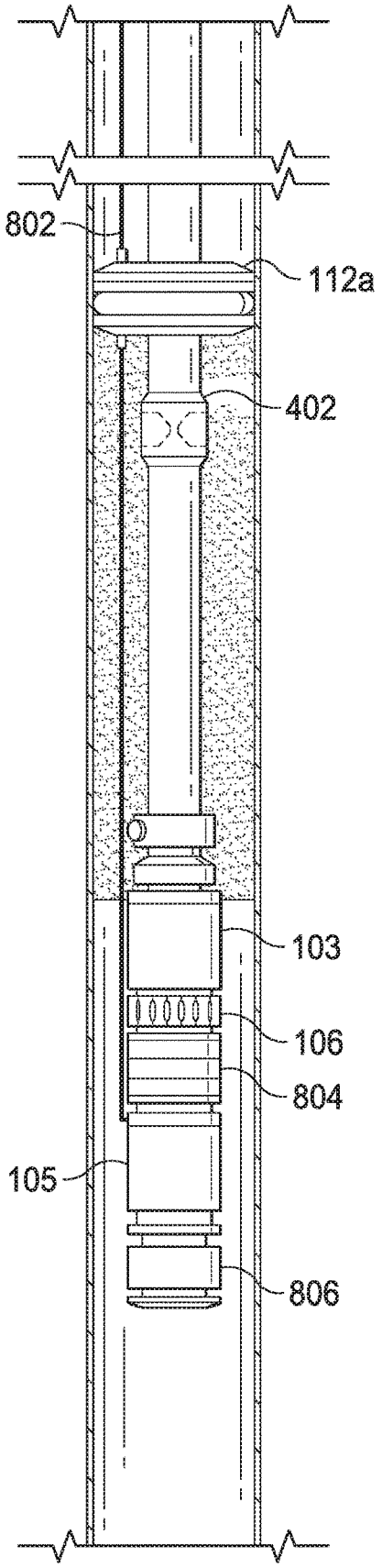
FIG. 10 is a schematic of an example of an implementation of an ESP system.
Figure 11A:
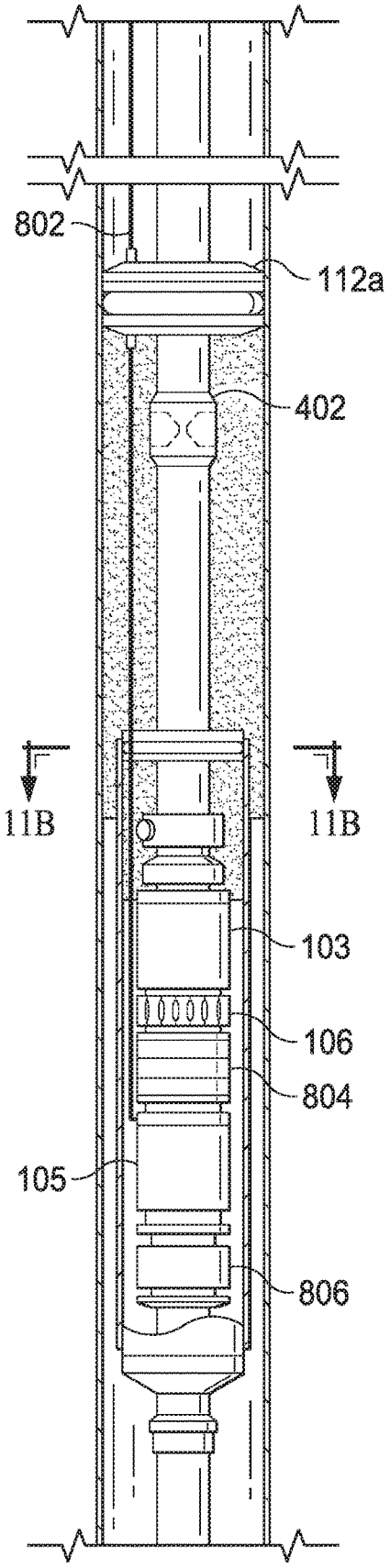
FIG. 11A is a schematic of an example of an implementation of an ESP system.
Figure 11B:
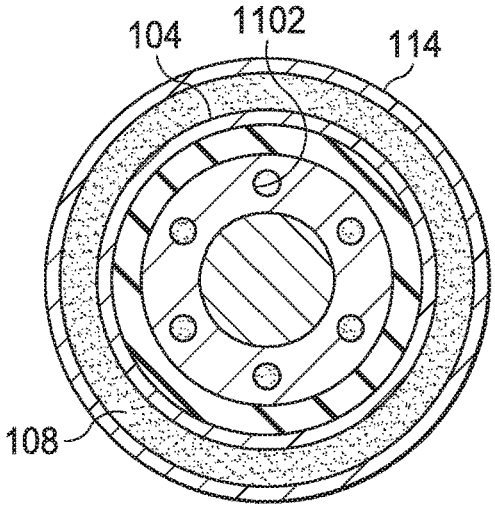
FIG. 11B is a cross-sectional view of the schematic of FIG. 11A.

FIG. 8 is a schematic of an example of an implementation of an ESP system. The ESP system of FIG. 8 is substantially similar to that of FIG. 7 except that the former does not include a shroud 104. In some implementations, the ESP system includes a power cable 802 that can run from the surface through the sealing assembly, for example, the packer 112*a*, to the ESP motor 105 to transmit instructions to the ESP motor 105. In some implementations, the ESP system can include a seal 804 that fluidically seals the ESP motor 105 from the fluids that flow into the ESP. The power cable 802 can additionally exchange data instructions with the ESP motor 105. In some implementations, the ESP system can include one or more sensors 806 that can transmit sensed information to the surface through the power cable 802. The ESP motor 105 can be operated based on, that is, in response to, the signals sensed by the sensor 806. FIG. 9 is a schematic of an example of an implementation of an ESP system. The schematic of FIG. 9 is substantially similar to that of FIG. 8 except that the former excludes the gas handler 702. FIG. 10 is a schematic of an example of an implementation of an ESP system. The schematic of FIG. 10 is substantially similar to that of FIG. 9 except that the jet pump 402 is downhole of the sealing assembly, that is, the packer 112*a*, and is open to the annulus directly and without a venting line. In such an implementation, the jet pump 402 is configured to draw the gases accumulated below the packer 112*a* into the production tubing and push the gases towards the surface. FIG. 11A is a schematic of an example of an implementation of an ESP system. The schematic of FIG. 11 is substantially similar to that of FIG. 10 except that the schematic includes a shroud similar to the shroud 107. In addition, as shown in the cross-sectional view of FIG. 11B, the top of the shroud includes ports 1102 to leak gas that accumulates in the shroud to an uphole region uphole of the shroud where the gas is drawn into the jet pump 402 to be raised to the surface. Similar to the implementation shown in FIG. 7, in some implementations, the jet pump 402 can be positioned within the shroud 104, for example, downhole of the uphole end 111 of the body 107 of the shroud 104.

Thus, particular implementations of the subject matter have been described. Other implementations are within the scope of the following claims.

The invention claimed is:

1. A well tool system comprising:

a downhole electrical submersible pump (ESP) system comprising:

a downhole ESP configured to be positioned in a wellbore formed in a hydrocarbon reservoir, the downhole ESP configured to receive hydrocarbons released from the hydrocarbon reservoir into the wellbore and to flow the hydrocarbons to a surface of the wellbore through a production tubing from an uphole end of the downhole ESP system to the surface, the hydrocarbons comprising liquid components and gaseous components, and a downhole ESP motor operatively coupled to the downhole ESP to provide power to the downhole ESP to flow the hydrocarbons to the surface;

a downhole shroud configured to encapsulate and fluidically seal the downhole ESP system, an uphole end of the downhole shroud configured to couple to a downhole end of the production tubing, wherein the gaseous components separate from the liquid components in the downhole shroud, wherein the downhole shroud comprises a sealing assembly forming a fluidic seal at an uphole end of the downhole shroud;

a downhole venting system fluidically coupled to the downhole shroud, the downhole venting system configured to flow the gaseous components towards the surface before the gaseous components enter the downhole ESP, wherein the downhole venting system comprises a vent line tubing fluidically coupled to the downhole shroud and the production tubing, the vent line tubing terminating at a wall of the production tubing and configured to flow the gaseous components from the downhole shroud to the production tubing;

a valve disposed along the vent line tubing between the downhole shroud and the production tubing to control flow of the gaseous components through the vent line tubing from the downhole shroud to the production tubing in response to pressure in the downhole shroud or in response to volume percentage of gas in the hydrocarbons at an inlet of the downhole ESP, or a combination thereof; and a jet pump configured to be positioned uphole of the downhole shroud, the jet pump configured to draw the gaseous components from the downhole shroud towards the surface.

2. The system of claim 1, wherein the vent line tubing comprises:

a first opening fluidically coupled to an inner volume of the downhole shroud; and a second opening positioned uphole relative to the first opening and configured to fluidically couple to the production tubing.

3. The system of claim 2, wherein the first opening is fluidically coupled to an uphole end of the downhole shroud.

4. The system of claim 2, wherein the vent line tubing has a length sufficient such that the second opening is configured to fluidically couple to the production tubing adjacent a base of a wellhead of the wellbore.

5. The system of claim 2, wherein the jet pump is configured to be positioned axially in-line with the production tubing and to be fluidically coupled to the production tubing, wherein the jet pump comprises a venturi configured to generate a pressure differential in response to the hydrocarbons flowing through the venturi, the pressure differential sufficient to draw the gaseous components from the downhole shroud towards the surface.

6. The system of claim 5, wherein the vent line tubing is coupled to the jet pump at the wall of the production tubing.

7. The system of claim 5, wherein the second opening of the vent line tubing is coupled to a downhole end of the jet pump at the wall of the production tubing.

8. The system of claim 1, wherein the vent line tubing is a first vent line tubing, wherein the downhole venting system comprises a second vent line tubing.

9. The system of claim 1, further comprising a valve system comprising the valve, the valve system fluidically coupled to the vent line tubing, the valve system configured to control flow of the gaseous components through the vent line tubing.

10. The system of claim 9, wherein the valve system comprises a valve controller operatively coupled to the valve, the valve controller configured to open or close the valve in response to fluidic conditions in the wellbore, the fluidic conditions comprising the pressure in the downhole shroud or the volume percentage of gas in the hydrocarbons at the intake of the downhole ESP, or a combination thereof.

11. The system of claim 10, wherein the valve controller comprises:

one or more processors; and a computer-readable medium storing instructions executable by the one or more processors to perform operations comprising:

receiving one or more signals representing the fluidic conditions in the wellbore, and transmitting one or more signals to open or close the valve responsive to the fluidic conditions represented by the one or more signals.

12. The system of claim 11, wherein the fluidic conditions comprise the volume percentage of gas in the hydrocarbons at the intake of the downhole ESP comprising a volumetric percentage of free gas at the inlet comprising an intake of the ESP, and wherein the operations comprise:

receiving the one or more signals representing that the volumetric percentage of free gas at the intake of the ESP is greater than a first threshold volumetric percentage; and transmitting the one or more signals to open the valve responsive to the volumetric percentage of free gas at the intake of the ESP being greater than the first threshold volumetric percentage.

13. The system of claim 12, wherein the operations comprise:

receiving the one or more signals representing that the volumetric percentage of free gas at the intake of the ESP is less than a second threshold volumetric percentage; and transmitting the one or more signals to close the valve responsive to the volumetric percentage of free gas at the intake of the ESP being less than the second threshold volumetric percentage.

14. A method comprising:

receiving, in a shroud encapsulating and fluidically sealing an electrical submersible pump (ESP) system comprising an ESP and ESP motor, hydrocarbons from a hydrocarbon reservoir, the ESP system positioned in a wellbore and the ESP coupled to production tubing at an uphole end of the ESP, the hydrocarbons separated into gaseous components and liquid components within the shroud;

sealing, by a sealing assembly, an uphole end of the shroud;

flowing, through vent line tubing fluidically coupled to the shroud and extending toward a surface of the wellbore through the sealing assembly, a portion of the gaseous components excluding the liquid components from the shroud toward the surface before the portion of the gaseous components flows into the ESP system, wherein the vent line tubing terminates at a wall of the production tubing;

drawing, by a jet pump positioned uphole of the shroud, the gaseous components from the shroud through the vent line tubing and into the production tubing towards the surface; and controlling flow of the gaseous components through the vent line tubing via a valve disposed along the vent line tubing in response to pressure in the shroud or in response to volume percentage of gas in the hydrocarbons at an inlet of the ESP, or a combination thereof.

* * * * *